United States Patent [19]

Goff et al.

[11] Patent Number: 4,573,394

[45] Date of Patent: Mar. 4, 1986

[54] MACHINE GUN

[76] Inventors: Charles W. Goff, 1267 West 1875 North, Farmington, Utah 84025; Charles W. Goff, Jr., 479 Laurelwood Dr., Kaysville, Utah 84037

[21] Appl. No.: 580,366

[22] Filed: Feb. 15, 1984

[51] Int. Cl.[4] ..... F41D 10/24

[52] U.S. Cl. ..... 89/33.01; 42/75 B; 42/75 C; 89/33.02; 89/199

[58] Field of Search ..... 42/75 B, 75 C; 89/33.01, 33.02, 199, 194, 197

[56] References Cited

U.S. PATENT DOCUMENTS

| | | | |
|---|---|---|---|
| 681,439 | 8/1901 | Carr | 89/33.02 |
| 1,293,396 | 2/1919 | Fox | 89/33.02 |
| 1,335,677 | 3/1920 | Fox et al. | 89/33.02 |
| 1,337,893 | 4/1920 | Farquhar et al. | 89/33.02 |
| 1,355,419 | 10/1920 | Pedersen | 89/145 |
| 1,462,852 | 7/1923 | Dawson et al. | 89/33.02 |
| 1,629,652 | 5/1927 | Browning | 89/33.02 |
| 1,674,370 | 6/1928 | Methlin | 89/33.01 |
| 1,747,546 | 4/1928 | Janecek | 89/33.02 |
| 2,112,660 | 3/1938 | Hudson | 89/33.1 |
| 2,174,851 | 10/1939 | Williams | 42/70 |
| 2,548,622 | 4/1951 | Sampson et al. | 42/69 |
| 2,627,208 | 2/1953 | Simpson | 89/33.01 |
| 2,785,605 | 4/1952 | Jourdat | 89/140 |
| 2,820,401 | 1/1958 | Gerick | 89/33.01 |
| 3,319,523 | 5/1967 | Casull | 89/33.02 |
| 3,366,010 | 1/1968 | Casull | 89/140 |
| 3,969,980 | 7/1976 | Bandstatter et al. | 89/33.02 |
| 3,969,981 | 7/1976 | Bandstatter et al. | 89/33.02 |

*Primary Examiner*—Stephen C. Bentley

*Attorney, Agent, or Firm*—Mallinckrodt, Mallinckrodt, Russell & Osburn

[57] ABSTRACT

With an automatic or semi-automatic weapon or gun, an improved component coupling arrangement for providing interlocking component assemblies of the receiver and barrel groups of the weapon, where, with a single screw coupling only in conjunction and interaction with a connector-less receiver top strap, the barrel and receiver groups are rigidly joined together, maintaining a cartridge feed block therewith that has a throat for receiving cartridges fed therethrough, which throat is in alignment with and between a barrel breech and in a cartridge discharge of a magazine juxtaposed thereto positioned to and between the barrel and receiver groups.

18 Claims, 15 Drawing Figures

MACHINE GUN

BACKGROUND OF THE INVENTION

1. Field

This invention relates generally to automatic firing guns, specifically to a type of gun known as a submachine gun and, more particularly, to a simplistic assembly arrangement for rigidly coupling together the gun subassemblies.

2. Prior Art

The value of any gas-operated projectile firing weapon, whether it be of a large or small caliber, is its accuracy and reliability for delivering fire on target. The market for automatic weapons is with law enforcement agencies and the military, where the weapon must sometimes be operated under adverse conditions and, yet, will still function reliably to deliver accurate fire on target. It is essential with fully automatic weapons, such as a machine gun or submachine gun, that the weapon fire consistently without jamming.

The present invention is an evolutionary outgrowth of and improvement on certain other U.S. patents; specifically, patents by R. J. Casull, U.S. Pat. Nos. 3,319,523 (1967) and 3,366,010 (1968), and later patents by Brandstatter et al., U.S. Pat. Nos. 3,969,980 (1976) and 3,969,981 (1976). These earlier patents were a basis for development and manufacture of a weapon known as the American 180 and show and describe an efficient and reliable weapons system capable of delivering a high volume of low caliber fire accurately on target, with almost no barrel climb, the present invention being an improvement thereon.

The present invention improves on the structure of the above-cited art, providing interlinking structures whereby, with only a single barrel retaining screw, the component assemblies are maintained together, holding a bullet cartridge feed block in position relative to the barrel and receiver groups and in alignment with a cartridge feed opening of a drum-type magazine. So arranged, cartridges fed from the magazine will be exactly aligned by the feed block for pickup from the undersurface thereof, in turn, by a reciprocating bolt. The bolt movement, in conjunction with the cartridge feed block mechanism, cams the cartridge off the feed block undersurface into the barrel breech for firing, with back travel of the bolt pulling spent cartridge casings from the barrel breech and ejecting them from a receiver cartridge exhaust. Where early arrangements, including the above-cited patents, have involved a number of pins, screws, bolts, or the like for fitting through aligned openings of the respective weapon groups, the present invention, by its interlocking assemblies, provides a gun that can be assembled and disassembled in a phenomenally short period of time, where the component assemblies are tightly coupled and the relative distance between the receiver and barrel groups is fixed to provide an optimum head spacing between the firing pin and the barrel breech. In a field setting, a person, with only a basic familiarity with the weapon, and little instruction, can easily assemble and disassemble the gun and perform basic cleaning and oiling thereof, including replacement of components such as the bolt.

SUMMARY OF THE INVENTION

It is, therefore, a general object of the present invention to provide an improved submachine gun of a type that utilizes a drum-type magazine and that utilizes interlocking components such that the weapon is held together by a single screw coupling.

Another object of the invention is to provide an improved connector less receiver top strap retaining arrangement whereby a top strap for covering over an open top portion of the weapon receiver, maintaining the reciprocating bolt therein is manually fitted over or removed from covering engagement to the receiver.

Another object of the present invention is to provide an interlocking arrangement between the receiver and barrel groups for exactly positioning and maintaining a cartridge feed block in alignment to a drum-type magazine cartridge discharge and aligned with the barrel breech, and for fixing and maintaining the head space distance between the barrel breech and a firing pin end of the reciprocating bolt.

Still another object of the present invention is to provide a simplistic arrangement of components of a submachine gun, whereby the components are arranged to securely interlock such that the weapon can be easily broken down and reassembled.

In accordance with the above objects, the present invention includes improvements to certain component assemblies or groups of a submachine gun commonly known as the American 180. The components and their interconnection arrangement interlock such that, with a single screw coupling only, a barrel group is locked to a receiver group, both fixing the head space distance of the barrel breech to the firing pin and maintaining a cartridge feed block therewith to align a throat thereof in exact alignment to a cartridge exhaust of a drum-type magazine and with the barrel breech. Top strap locking to a receiver top portion is provided by including with the top strap spaced apart flanges extended outwardly from the longitudinal sides of the top strap undersurface that align with inwardly projecting rail sections formed in the receiver longitudinal top edges, the strap flanges to slide beneath the receiver rails as the top strap is slid rearward relative to the weapon stock. At the top strap limit of rearward travel, a spring biased pin-lock or detent arrangement is provided to maintain that top strap covering that portion of the receiver above the reciprocating bolt. Such detent includes a spring biased ball or plunger that travels into an opening in the strap end. The pin-lock or detent is easily released by application of a horizontal force to the top strap sight end that overcomes the spring biasing, with the pin or plunger traveling out of the opening allowing the strap flanges to travel forwardly along the undersurface of the receiver rails until again aligned with the openings therebetween whereat the top strap is free to be lifted off from the receiver. This connector less coupling simplifies opening the weapon receiver to provide access to the spring biased bolt therein.

The assembled receiver and strap arrangement and the single screw coupling of the barrel group to the receiver group, in addition to their interlocking coupling provide for aligning and positioning a cartridge feed block that is held therebetween a throat thereof in alignment to a cartridge discharge or exhaust of a drum-type magazine. The cartridge feed block provides a platform wherethrough the cartridges pass and are picked up from the undersurface, in turn, by the reciprocating bolt as it moves forward in the receiver and inserts the cartridge into the barrel breech, a firing pin thereof firing the cartridge, and an ejector alongside the firing pin withdrawing and ejecting the cartridge casing. The cartridge feed block includes a pair of spaced apart, arcuate shaped ears that extend parallel and outwardly from one end thereof for fitting, in close tolerance, into arcuate grooves formed in opposite sides of the barrel breech end, the arcuate shape thereof providing for exact alignment of the feed block relative to the barrel breech when the ears are fully installed in the grooves, the other feed block end held in place against the receiver stepped portion by an overhanging end of the receiver top strap installed to the receiver.

The single screw connection arrangement discussed above includes, in combination, a barrel receiving pin fitted laterally through the receiver projecting above the receiver bottom for receiving complementary groove formed across the barrel, the groove positioned of top of the pin functioning as a pivot wherearound the barrel group is pivoted into the receiver for aligning it within the receiver. Thereafter a barrel retention screw, as the single screw freewheeling in the receiver bottom, is turned into a threaded hole in the barrel, locking the barrel group thereto. The barrel retention screw preferably includes a large head for manually turning the threaded end thereof into the barrel threaded hole, the screw and the pivot exactly positioning the barrel with regard to the receiver group, fixing the head space distance between the barrel breech and the bolt firing pin end.

The weapon of the present invention is unique in that it provides an interrelationship of components whereby the weapon can easily be broken down into individual groups and parts and reassembled, the critical components in exact alignment by manual turning of a single screw only, facilitating in-field maintenance and repair.

BRIEF DESCRIPTION OF THE DRAWING

In the drawings is shown that which is presently regarded as the best mode for carrying out the invention.

DETAILED DESCRIPTION OF THE DRAWINGS

Figure 1:
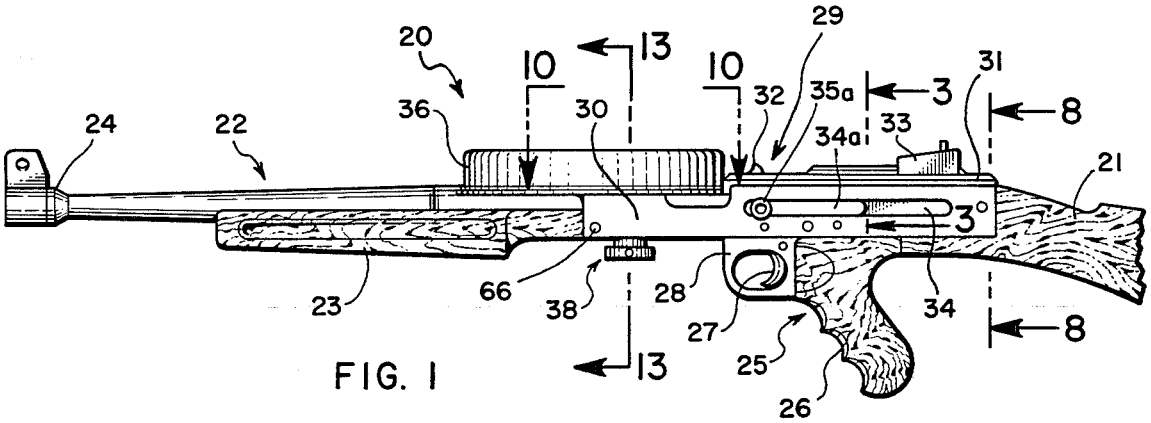
FIG. 1 is a side elevation view of the submachine gun of the present invention.
Figure 3:
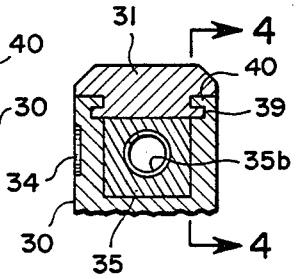
FIG. 3 is a partial sectional view taken along the line 3—3 of the receiver group of FIG. 1, showing a lateral cross-section of the reciprocating bolt, with a rear sight being omitted for clarity.

Referring now to the drawings:

FIG. 1. shows a side elevation view of submachine gun 20 of the invention, hereinafter referred to as "gun". Gun 20 is shown herein as a gun that is capable of full automatic operation, utilizing an "open bolt" configuration. It should, however, be recognized that the described gun 20 can operate in semi-automatic mode and that, with modification to the bolt only, can be limited to semi-automatic operation only, which arrangments are within the present disclosure and cited prior art. Gun 20 includes a stock 21 (a butt portion of which is shown broken away) a barrel group 22 that includes a hand grip 23 and a front sight 24; a trigger group 25 that includes a pistol grip 26 for holding by an operator to squeeze with his finger a trigger 27 that is located within a trigger guard 28; and a receiver group 29 that includes a receiver 30 that includes an open rearward stepped top portion as relating the receiver connection to stock 21, and a top strap 31 for closing over the receiver open top. The top strap includes, on the forward end thereof, as relating to the receiver connection to the barrel group, a drum-type magazine latch 32 with a rear sight 33 secured across the rear end thereof. Shown in FIG. 1, the receiver 30 has a longitudinal slot 34 formed therein, wherefrom projects a knob **35*a* of a slide 34*a* for engaging and pulling rearward a reciprocating bolt 35. A sectional view of FIG. 3, shows reciprocating bolt 35 biased by coil spring 35*b* as it is maintained within the receiver 30. As will be discussed later herein, the reciprocating bolt is arranged to move back and forth within the receiver, picking up cartridges from an undersurface of a throat of feed block 37, camming them into a barrel breech end, where a fixed firing pin end, not shown, of that reciprocating bolt strikes the cartridge primer, with an extractor of the reciprocating bolt face with the firing pin, not shown, then withdrawing the spent cartridge casing for ejection. The cartridges are serially fed into the cartridge feed block from a drum-type magazine 36, preferably like the drum shown by Brandstatter et al., U.S. Pat. No. 3,969,980, that will feed, under a spring pressure, a flow of cartridges through an exhaust, discharge or exit port into a throat 60 of feed block 37**, the operation of which feed block will be described in detail later herein.

The gun 20 consists essentially of the assemblies or groups set out above for firing a small caliber shell, preferably a twenty-two caliber conventional or magnum round, that, for an open bolt weapon firing full automatic, will fire at an approximate rate of eighteen hundred rounds per minute. The preferred drum-type magazine holds one hundred seventy-seven rounds and can be emptied at this rate of fire in approximately six seconds, providing thereby a capability for placing a high-volume of fire on target in a very short period of time.

Several embodiments of the gun have been produced and marketed under the patents cited earlier herein (Casull, U.S. Pat. Nos. 3,319,523 and 3,366,010, and Brandstatter, et al, 3,969,980 and 3,696,981) that show the prior art that this invention improves upon. The present invention, therefore, should be understood to constitute an improvement over such earlier gun in individual component assemblies and their interaction. Essentially, therefore, the preferred arrangements of the trigger group 25; the bolt 35, that functions as either an open or closed bolt; the stock 21; and the drum-type magazine 36 are like those components incorporated in earlier weapons and are shown and described in detail in these earlier patents, or like earlier references, and will, therefore, not be discussed in detail herein. The disclosure of these earlier patents is therefore adopted by this reference.

The present invention is directed to an improved receiver 30 of the receiver group 29, with top strap 31 arrangement; an improved feed block 37 locking; and an improved barrel group 22 attachment arrangement for securing that barrel group to the receiver group. These assemplies and components and their interrelationship with the earlier known components as set out in detail below provide a gun 20 that can be constructed for semi-automatic fire only or for automatic or semi-automatic mode and provides for rapid and efficient disassembly into component assemblies and parts by turning of a single barrel retention screw only. Such connection arrangement, in cooperation with the interlocked component assemblies, serves also to fix in place the cartridge feed block in the receiver group to exactly align throat 60 thereof in exact alignment with the magazine cartridge exhaust and with the barrel breech. The feed block receives and positions each cartridge through the throat, in turn, for pick-up by the moving bolt from the undersurface thereof. With gun 20 constucted to be capable of full automatic fire, the bolt is cocked by pulling bolt handle **35*a* rearwardly against spring biasing 35*b* to an open attitude. When the trigger is pulled, the bolt moves forward, the bolt face picking up a cartridge out from the feed block throat and guiding it into a barrel breech. At the limit of forward bolt travel with respect to the barrel breech, a firing pin projecting from that bolt end strikes the cartridge primer, igniting the power therewithin. The back thrust of the exploding powder forces the cartridge casing against the bolt, pushing it back against the bolt spring biasing, the empty cartridge casing maintained by an ejector arranged on the bolt face traveling therewith until the cartridge casing is ejected downwardly through a receiver bottom or discharge opening 58**. Rearward bolt travel then continues to a point where, if the trigger is released, a sear thereof, not shown, will engage the bolt to retain it in an open or cocked attitude. If, however, an operator continues to depress the trigger, the sear will not engage the bolt that will continue to travel back and forth in the receiver, picking up and firing cartridges at a rapid rate.

Figure 2:
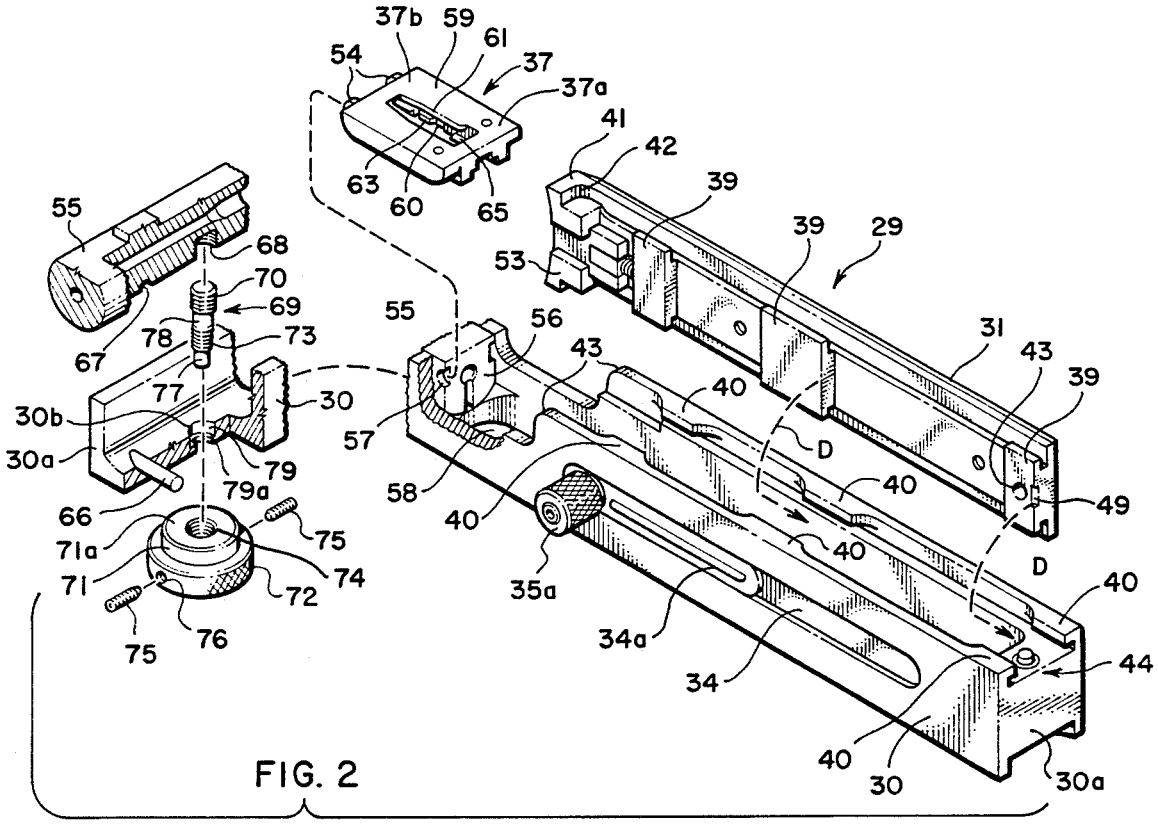
FIG. 2 is a perspective view of the breech portion of the weapon barrel and receiver group with components thereof exploded away from the assemblage.
Figure 4:
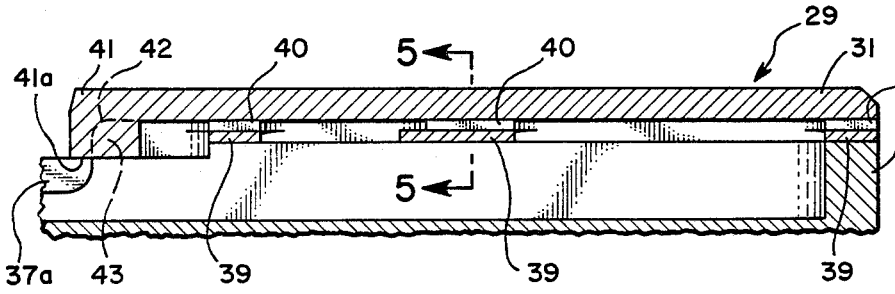
FIG. 4 is a side elevation sectional view taken along the line 4—4 of FIG. 3, showing a section of the receiver as in FIG. 1, with the reciprocating bolt and sight rail being omitted for clarity.
Figure 6:
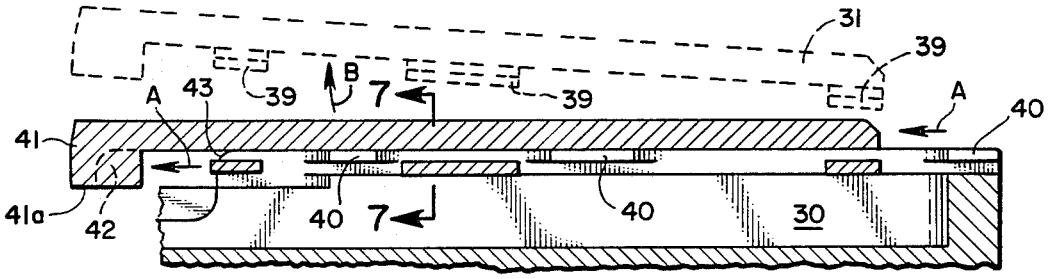
FIG. 6 is a view like that of FIG. 4, showing, arrow A, the top strap slid forward with flange sections thereof shown sliding out from under receiver rail sections with, in broken lines, the top strap shown lifted off from the receiver, arrow B.
Figure 5:
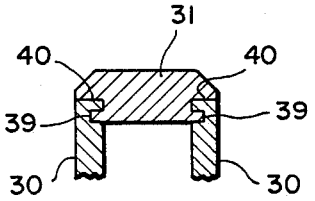
FIG. 5 is a sectional view taken along the line 5—5 of FIG. 4, showing a receiver top strap in its covering attitude over the receiver.
Figure 7:
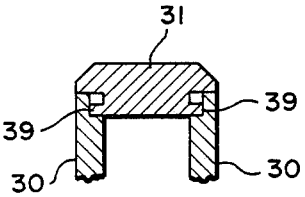
FIG. 7 is a sectional view taken along the line 7—7 of FIG. 6, showing the top strap flange sections free of the receiver rail sections.

Turning to the individual component assemblies of gun 20, shown in FIG. 2, the receiver group 29 includes the receiver 30, a box-like structure that is stepped at a rearward-most top portion and is open along the top and on one end whereto the barrel group is fitted. The receiver along the stepped portion accomodates the bolt 35 reciprocating therein. The trigger group 25 is mounted in the receiver bottom with the sear thereof, not shown, extending into the receiver to interrupt bolt travel by engaging a lateral groove in the bolt understructure, not shown, when the trigger is released. The bolt of this embodiment is thereby held in an open or cocked attitude. The receiver top is covered by installation of the top strap 31, as illustrated by broken arrow D in FIG. 2, that shows pairs of spaced apart top strap flange sections 39 fitted through openings between receiver rail sections 40, and the top strap moved rearwardly, the flange sections to travel under the receiver rails 40, as shown also in FIGS. 6 and 7. The top strap is urged rearwardly by an operator pushing with his hand on top strap forward end 41, FIG. 6, or pulling against the sight group 33, FIG. 1, to slide the flange sections 39 sliding beneath the rail sections 40 to the receiver covering attitude shown in FIG. 4. Shown in FIGS. 2 and 4, the top strap forward end 41 includes curved grooves 42 that are inset in opposite sides thereof, which grooves conform to the curve of receiver group ends 43. So arranged, when the top strap is moved to covering attitude over the stepped portion of the receiver open top, as shown in FIGS. 2 and 4, the curved surfaces of the respective top strap grooves 42 will closely fit against the receiver ends 43, providing a barrier to further top strap rearward travel. The sectional views of FIGS. 3 and 5 show the top strap flange sections 39 locked under the receiver rail sections 40, with FIG. 3 showing also the bolt 35 and the a coil spring **35*b*** for spring biasing the bolt.

Figure 8:
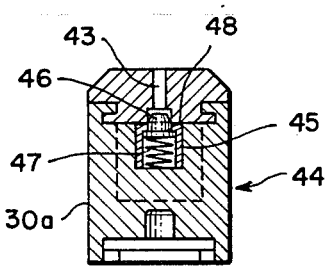
FIG. 8 is an end sectional view taken along the line 8—8 of FIG. 1 showing a strap locking arrangement, with the sight and sight rail for clarity, as including a plunger lock.
Figure 9:
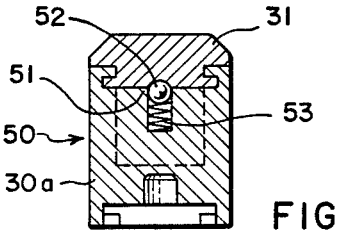
FIG. 9 is a view like that of FIG. 8, only showing another embodiment of a strap lock arrangement, as including a ball check lock.

To maintain the top strap 31 in covering attitude over the top of the receiver body 30, a hole or depression 43 is centrally formed in the rearmost top strap end, flange 39, shown in FIG. 2, to align with a strap lock 44 when the strap is moved fully rearwardly as described above. The strap lock is a spring biased ball or detent arranged to releasably maintain the top strap positioned over the receiver until an appropriate force is applied thereto by an operator applying a horizontal force thereagainst with his hand to slide the top strap forward. FIGS. 8 and 9 show two different embodiments of preferred detent-type strap lock configurations. The embodiment of FIG. 8 consists of forming a vertical receiver hole 45 in the receiver 30 rear end **30*a* and positioning within that hole, as a detent, a plunger 46. The plunger is shown as a top hat design to have a rounded top and includes a wide base to rest on a spring 47** positioned therein. The plunger is retained by a retaining O-ring 48, sleeve, or the like. So arranged, by sliding the top strap flanges beneath the receiver rails, as illustrated by arrow D in FIG. 2, a top strap ramp 49, formed in the top strap undersurface, will engage the plunger rounded top. Further rearward top strap travel depresses that plunger against the biasing of the spring 47, until the plunger end aligns with the receiver hole 45, whereat the plunger rounded end will travel into that hole, providing thereby a locking of the strap to the receiver. This locking can be overcome, as by a person pushing horizontally with the heel of his hand against the top strap rear sight 33 to urge that plunger end from the hole 45, with top strap travel compressing spring 47, until ramp 49 is reached. Further top strap travel toward the barrel group slides the flange sections 39 out from under the receiver rail sections 40 to the attitude shown in FIG. 6, where the top strap can be lifted off from the receiver.

FIG. 9 shows another embodiment of a strap lock 50 that is like the strap lock 44 of FIG. 8, except that, rather than the plunger 46 of FIG. 8, a ball 52 is fitted into of a receiver hole 51, with biasing of ball 52 provided by installation of a spring 53 within that receiver hole. A ball check-type lock is thereby formed. The ball 52 is preferably retained within the hole 51 as by bradding the area around the lip of the receiver hole so as to lessen the hole diameter after the ball and spring are installed therein. A permanent seat of the ball and spring in that hole is thereby provided with the spring 53 compressed therein. The strap lock of this embodiment, and the embodiment described with respect to FIG. 8, function similarly, with ball 52 substituted for plunger 46, and spring 53 functioning like spring 47, both arrangements providing a releaseable locking of the strap to the receiver. With both the strap lock 44 of FIG. 8 and the strap lock 50 of FIG. 9, release is preferably accomplished by a person pushing horizontally with the heel of his hand against the rear sight 33 of the strap so as to urge that top strap forward, the plunger or ball is forced against spring biasing to move the plunger or ball out of the receiver hole.

FIG. 2 shows a forward or toe end 41*a* of the receiver top strap 31 overhanging and closely fitting against a rear end 37*a* of the feed block 37. So arranged, the feed block is restrained from vertical movement at end 37*a*. Shown best in FIGS. 2 and 12, the other or opposite feed block end 37*b* includes a pair of spaced apart ears 54 that are preferably arcuate in shape and project outwardly and perpendicular therefrom. Shown in FIG. 2, the arcuate ears 54 will align with to slide into complementary arcuate slots 57 that are formed in opposite parallel sides of a breech 56 of barrel 55. With the barrel and receiver groups secured together as shown in FIGS. 1, 2, 10 and 11, the feed block is maintained on one end 37*b* by the close coupling of arcuate ears 54 fitted in the arcuate slots 57 in barrel 55, with rear end 37*a* held in place by the overhanging end 41*a* of the receiver top strap, the feed block thereby exactly aligned in the receiver such that the throat 60 top will be in proper alignment to the cartridge exhaust and to the drum magazine fitting thereover, as shown in FIG. 1, with the throat undersurface in alignment with the barrel breech 56. Cartridges from that magazine exhaust thereby pass through the throat and are positioned, in turn, for pick-up from the feed block throat undersurface by the forward of the firing pin end of bolt 35. The feed block, as the bolt end travels thereunder, is arranged to provide for camming each cartridge downwardly into the barrel breech, with the bolt picking up the cartridge and, at its limit of forward travel, firing the cartridge, and, thereafter, traveling rearwardly to pull the spent casing therefrom and eject it through a receiver discharge or ejection port 58, the casings flowing therefrom past the trigger guard 28.

Figure 11:
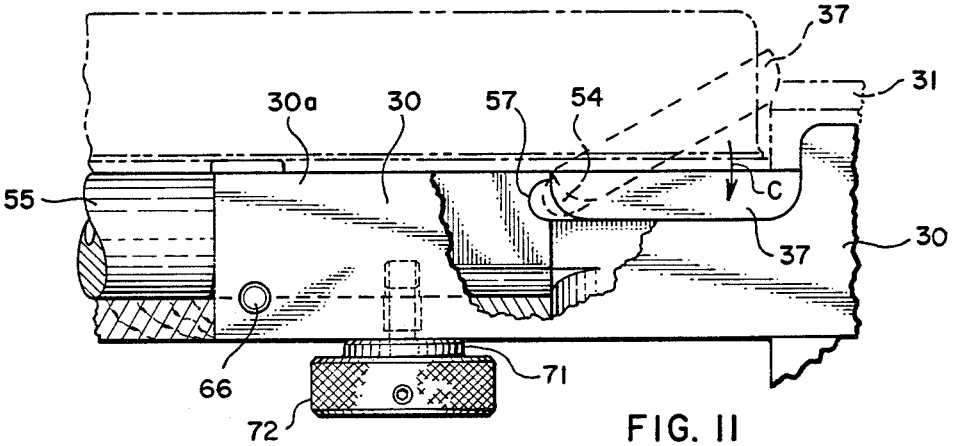
FIG. 11 is a side elevation sectional view taken along the line 11—11 of FIG. 10, showing a portion of the receiver removed to expose the barrel fitted therein, the drum-type magazine and receiver top strap end shown in broken lines, with the cartridge feed block shown rotated in broken lines, arrow C, and maintained in a locked attitude by an overhanging end of the top strap end, shown in solid lines.
Figure 13:
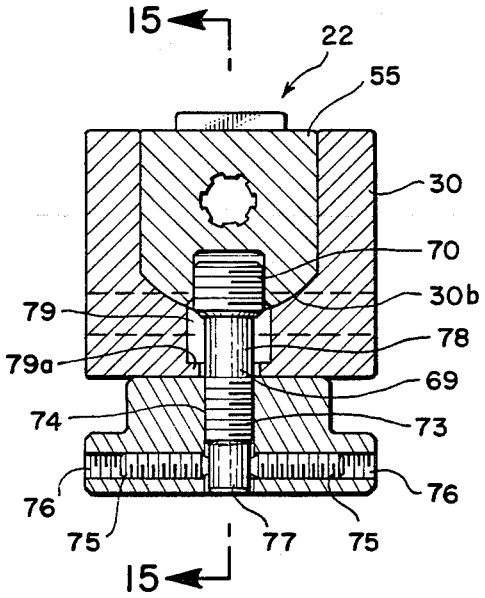
FIG. 13 is a sectional view taken along line 13—13 of FIG. 1, with the drum-type magazine removed for clarity, showing the barrel connected by a single barrel retaining screw to the receiver group.
Figure 15:
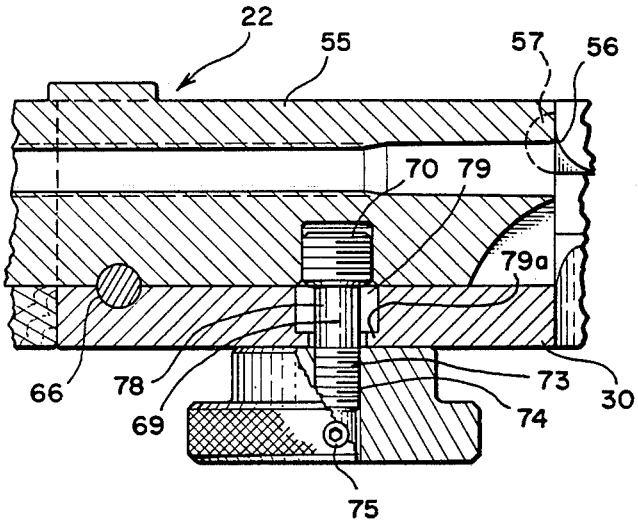
FIG. 15 is a side elevation sectional view taken along line 15—15 of FIG. 14, showing also the barrel positioning pin installed in a lateral groove formed in the barrel.
Figure 14:
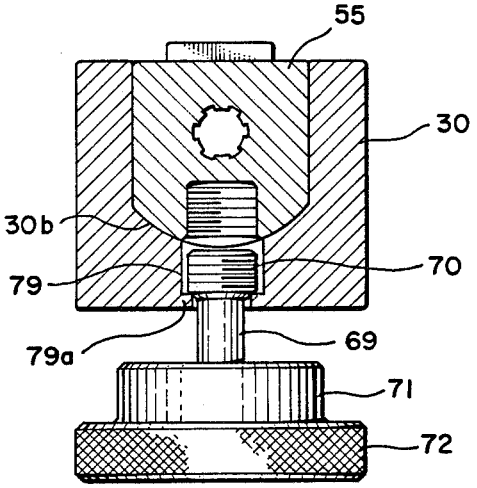
FIG. 14 is a view like that of FIG. 13, except the barrel retaining screw is shown turned out of the barrel.
Figure 12:
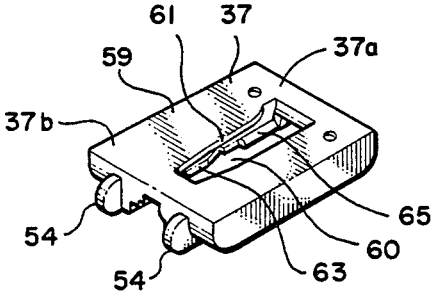
FIG. 12 is a profile perspective view of the preferred cartridge feed block of the invention.

In securing the feed block to the gun 20, the feed block arcuate ears 54, as shown in FIG. 11, are fitted into the barrel arcuate slots 57 and, prior to installing the described top strap 31 over the stepped portion of the receiver 30 top, the feed block is rotated into the position shown by the solid line representation and the top strap 31 is then slid thereover. Alternatively, the feed block rear end 37*a* can be slid under the top strap end 41 and rotated onto its seat on the receiver, the feed block ears fitted into the barrel slots at the time the barrel group is installed to the receiver group.

Excepting the described feed block arcuate ears 54 that interlock with the described barrel arcuate slots 57 and provide for maintaining the feed block positioning relative to the barrel breech, the cartridge feed block of the present invention is substantially like the cartridge feed block shown and described in the cited patent by Brandstatter et al., U.S. Pat. No. 3,969,980. Feed block positioning in this Brandstatter patent is maintained by pin holes or openings formed through the feed block that receive alignment pins that extend vertically upward from opposite sides of the receiver. While this earlier pin arrangement did provide for feed block positioning, it did not restrain vertical movement of that feed block. The present invention, therefore, improves on the earlier structure by providing the arcuate ears 54 to fit into the barrel arcuate slots 57 to both position and lock the feed block 37 in the assembled weapon.

Figure 10:
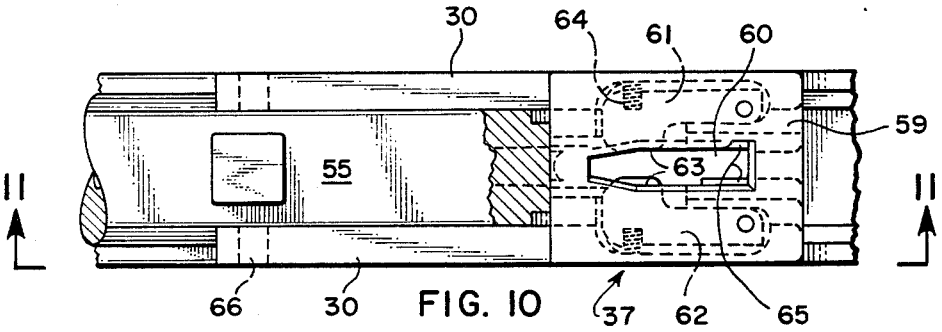
FIG. 10 is a top plan sectional view taken along the line 10—10 of FIG. 1 with a drum magazine and an end of the receiver top strap removed for clarity, showing a top portion of a barrel portion broken away to expose the breech thereof, and showing a cartridge feed block, with components thereof shown in broken line, the feed block installed to the receiver and aligned relative to the barrel breech.

Except as set out above relative to arcuate ears 54, the feed block 37 is like the earlier feed block of the Brandstatter et al. patent. Therefore, the feed block 37 components and their function are like those of like the earlier feed block, and so will be described only briefly herein. Feed block 37 is shown in FIG. 10, with the internal components thereof shown in broken lines, and in a perspective view of FIG. 12. Shown therein, the feed block 37 includes an upper or top surface 59 that, with the feed block positioned to receiver, is juxtapositioned with the undersurface of the magazine 36 that is retained between the barrel and receiver, the feed block including a longitudinally extending cartridge throat 60 formed therethrough that is of a length and width sufficient to permit a cartridge to feed therethrough, which throat is aligned to the magazine exhaust. The feed block, as described in the above-cited patent, preferably consists of sandwiched upper and lower plates or layers, the upper or first layer including a transverse rim or edge 61 on each long side of the cartridge throat adjacent the magazine exhaust that is included to provide a smooth funneling action into the throat to cartridges fed therein from the magazine feed. Below the beveled edges, in the lower or second layer, are arranged two laterally opposed coplaner leafs 62 that are pivotally connected and biased by springs 64 to bring edges 63 thereof into engagement with the sides of a cartridge fitted therein. The spring biasing is such that, as a cartridge is picked up from the feed block by the firing pin end of the bolt 35, a following cartridge will be forced, by the the action of the magazine spring, to overcome that biasing to partially pass through the feed block throat, and is retained therein between edges 63. The cartridge casing rim will then come to rest on rear flanges 65 of that lower or second layer for pick-up from the undersurface thereof by the bolt edge for delivery into the barrel breech, firing, and ejection of the spent casing as described.

Shown in FIGS. 2 and 11, the barrel group installation arrangement of the present invention, for joining it by a single screw to the receiver group, includes a receiver barrel positioning pin 66 that is secured within the receiver so as to extend laterally thereacross, just extending or projecting above the receiver bottom 30*b*, and is located back from the forward or barrel connecting receiver end 30*a*, which positioning pin is arranged to seat in a lateral groove 67 formed in the barrel 55, which groove is forward from the barrel breech 56 or toward the barrel muzzel end. The interaction of the barrel groove 67 seated onto pin 66 provides a pivot coupling that acts also to align and position the barrel in that receiver group. After the barrel lateral groove 67 is so seated onto the receiver barrel positioning pin 66, the barrel can be rotated to bring the breech 56 into the receiver to align a tapped or threaded hole 68 formed radially into the barrel into alignment with an upper threaded end 70 of a barrel retaining screw 69. The barrel retaining screw, described hereinbelow, is preferably formed to have a smooth center area 78 for fitting into and being maintained in free-wheeling arrangement in a hole 79 formed through the receiver bottom 30*b*. The preferred barrel retaining screw arrangement is shown turned out of barrel threaded hole 68 in FIG. 14, and is shown turned into that hole in FIGS. 13 and 15. The barrel retaining screw 69, shown in FIGS. 2, 11, 13, 14, and 15, is preferably assembled to include a knob 71 with a center longitudinal hole 74 that is fitted onto an unthreaded shank end 77 of the screw, which knob preferably includes a greater diameter knurled surface 72 for facilitating a person turning that knob with their fingers to assemble and disassemble the gun barrel group from the receiver group. The barrel retaining screw includes a lower threaded portion or segment 73 that is turned into threads tapped into the knob center hole 74. Locking of the knob to the screw is provided by installation of set screws 75, shown best in FIG. 2, that are fitted into and turned into opposing radial threaded openings 76 formed into the knob knurled surface 72 to intersect the knob center hole 74. Shown in FIG. 13, the set screws are turned against the unthreaded shank end 77 of the barrel retaining screw 69, locking thereto. Shown in FIGS. 2, 13, and 15, the open unthreaded center area 78 of the barrel retaining screw provides for some vertical travel and allows the barrel retaining screw to free-wheel in the hole or opening 79 formed through the receiver bottom 30*b*. The opening 79 includes an inwardly projecting lip 79*a* that provides a stop butt against a first or lower thread flight of threaded end 70 to block withdrawal of that retaining screw upper threaded end. So arranged, to mount the barrel retaining screw in the receiver, the screw shank end 77 is fitted through to extend from the receiver opening 79 and the knob 71 is then installed thereto, with the knob set screws 75 turned to engage and bind against that shank end. To install the barrel group to the receiver group, the barrel lateral groove 67 is seated on the receiver positioning pin 66, and the barrel group is rotated therearound to bring the barrel breech end 56 into the receiver. The upper threaded end 70 of the barrel retaining screw 69 thereby aligns so as to be turned into the barrel threaded hole 68. Turning the barrel retaining screw causes the barrel to be drawn snugly into the receiver, providing one point of locking contact, with the pivot arrangement of the barrel positioning pin and receiver barrel groove providing a second metal-to-metal point of contact. The two points of metal-to-metal contact exactly position and rigidly lock together the barrel group relative to the receiver group. This rigid coupling of the barrel and receiver groups also fixes the head space distance between the firing pin end of bolt 35 and the barrel breech end 56, which optimum distance is thereafter maintained without adjustment.

The present invention provides a simplified interlocking arrangement of the components of the gun 20 of the present invention, facilitating assembly and disassembly of the barrel and receiver groups, which interconnection also provides for setting and maintaining feed block alignment and positioning and sets the weapon head space. Thereby, by manual turning of a single barrel retention screw only the weapon components are rigidly coupled together. A person, in a field setting, can therefore, in a matter of seconds only, disassemble the gun into its components assemblies, including removing the bolt and bolt spring from the receiver, for cleaning and maintenance, and in a like time period can reassemble the weapon.

Herein has been described the perferred combination of components and the components themselves making up the submachine gun of the present invention. It should be understood that the present disclosure applies to both automatic and semi-automatic weapons, and is made by way of example only, and that changes can be made thereto without departing from the subject matter coming within the scope of the following claims, which claims we regard as our invention.

We claim:

1. A machine gun comprising, with a receiver group that includes a rectangular box shaped receiver that is stepped at a rearward top end as relating to a stock for connection to said receiver group and is open across its top and a forward end as relating to a connection to a barrel group and contains a spring biased bolt whose reciprocating travel within the receiver is initiated and stopped by operation of a trigger group fitted through a receiver undersurface, and includes a receiver top strap arranged for coupling in a covering attitude over a stepped end of said receiver open top, said top strap including means for releasably coupling said top strap in covering engagement over said receiver stepped top that consists of flange sections that extend horizontal outwardly, at spaced intervals, from opposite longitudinal sides of the top strap undersurface, and spaced apart horizontal inwardly projecting rail sections formed at intervals in longitudinal sides of the receiver stepped top to accomodate said flange sections for fitting therebetween to slide along said rail section undersurfaces as the top strap is moved longitudinally to a covering attitude, including a means for releasably maintaining the top strap in its receiver covering attitude; cartridge feed block means maintained in said receiver group adjacent to said barrel group, a throat thereof parallel to and in alignment with a juxtapositioned cartridge discharge of a magazine wherethrough cartridges are serially exhausted, the feed block means receiving each cartridge in turn through said throat for positioning it for pick-up and insertion into a barrel breech of the barrel group by reciprocating travel of said bolt that picks up each cartridge, in turn, installs and fires it in the barrel breech, and extracts the empty casing to eject it through an exhaust of said receiver; means for maintaining said cartridge feed block means to said receiver group, in exact alignment with said throat thereof juxtapositioned and opposite said magazine cartridge discharge and relative to said barrel breech for said cartridges to be cammed therefrom into said barrel breech by said bolt travel; and means, including a single screw, for aligning and securing said barrel group to said receiver group.

2. A machine gun as recited in claim 1, wherein the means for releasably maintaining the top strap in its receiver covering attitude includes, in a cavity formed in said receiver closed end, a detent means and spring biasing therewith for extending beyond said receiver end to intersect an undersurface of said top strap installed thereover; a hole formed in said top strap undersurface proximate to a rearmost end thereof to align with and function as a seat for said detent means at a limit of covering travel of said top strap over said receiver top; and ramp means formed in said top strap end adjacent to said seat for contacting and depressing said detent means against said spring biasing as said top strap is slid into covering engagement.

3. A machine gun as recited in claim 2, wherein the detent means is a round ball seated with a coil spring in the receiver cavity.

4. A machine gun as recited in claim 2, wherein the ball means is a top hat shaped plunger with a coil spring contacting the rim thereof and located in the receiver cavity.

5. A machine gun as recited in claim 2, further including a stop means for limiting travel of the top strap in covering arrangement over the receiver top where the receiver top strap forward end includes rounded grooves formed in opposite sides thereof for fitting in complementary rounded forward ends of the longitudinal sides of the stepped portion of the receiver top.

6. A machine gun as recited in claim 1, wherein the means for maintaining the cartridge feed block means consists of a seat for said cartridge feed block means forward from said receiver stepped portion, with said top strap forward end to overhang one end of said seat, to closely fit proximate to and across one end of said cartridge feed block means when said top strap is installed in covering attitude over said receiver top, and forwardly projecting spaced apart ears that extend in the plane of said cartridge feed block means to fit within complementary slots formed in opposite sides of the barrel breech.

7. A machine gun as recited in claim 6, wherein the ears and complementary slots are arcuate in shape.

8. A machine gun as recited in claim 1, wherein the means, including a single screw, for aligning and securing said barrel group to said receiver group consists of a round pin fitted laterally through opposite receiver sides within and projecting upwardly from said receiver bottom to receive a complementary lateral groove formed in the barrel forward from breech end, said groove fitted on the pin functioning as a pivot such that when the barrel group is rotated therearound, bringing the barrel breech into the receiver, a radial threaded hole formed in the barrel will align with an opening formed through said receiver bottom; and a barrel retaining screw maintained in said opening in said receiver bottom that includes a threaded end for turning into said barrel radial threaded hole, to draw the barrel group into position in said receiver providing points of rigid connection at said barrel retaining screw and said pivot.

9. A machine gun as recited in claim 8, wherein the barrel retaining screw is free-wheeling in the receiver bottom opening and includes a large head to accomodate manual turning.

10. A machine gun comprising, with a receiver group that includes a rectangular box shaped receiver that is stepped at a rearward top end as relating to a stock for connection to said receiver group and is open across its top and a forward end as relating to a connection to a barrel group and contains a spring biased bolt whose reciprocating travel within the receiver is initiated and stopped by operation of a trigger group fitted through a receiver undersurface, and includes a receiver top strap arranged for coupling in a covering attitude over a stepped end of said receiver open top, said top strap including means for releasably coupling said top strap in covering engagement over said receiver stepped top that consists of flange sections that extend horizontal outwardly, at spaced intervals, from opposite longitudinal sides of the top strap undersurface, and spaced apart horizontal inwardly projecting rail sections formed at intervals in longitudinal sides of the receiver stepped top to accomodate said flange sections for fitting therebetween to slide along said rail section undersurfaces as the top strap is moved longitudinally to a covering attitude, including a means for releasably maintaining the top strap in its receiver covering attitude; cartridge feed block means maintained in said receiver group adjacent to said barrel group, a throat thereof parallel to and in alignment with a juxtapositioned cartridge discharge of a magazine wherethrough cartridges are serially exhausted, the feed block means receiving each cartridge in turn through said throat for positioning it for pick-up and insertion into a barrel breech of the barrel group by reciprocating travel of said bolt that picks up each cartridge, in turn, installs and fires it in the barrel breech, and extracts the empty casing to eject it through an exhaust of said receiver; means for maintaining said cartridge feed block means to said receiver group, in exact alignment with said throat thereof juxtapositioned and opposite said magazine cartridge discharge and relative to said barrel breech for said cartridges to be cammed therefrom into said barrel breech by said bolt travel; and means for aligning and securing said barrel group to said receiver group.

11. A machine gun as recited in claim 10, wherein the means for releasably maintaining the top strap in its receiver covering attitude includes, in a cavity formed in said receiver closed end, a detent means and spring biasing therewith for extending beyond said receiver end to intersect an undersurface of said top strap installed thereover; a hole formed in said top strap undersurface proximate to a rearmost end thereof to align with and function as a seat for said detent means at a limit of covering travel of said top strap over said receiver top; and ramp means formed in said top strap end adjacent to said seat for contacting and depressing said detent means against said spring biasing as said top strap is slid into covering engagement.

12. A machine gun as recited in claim 11, wherein the detent means is a round ball seated with a coil spring in the receiver cavity.

13. A machine gun as recited in claim 11, wherein the detent means is a top hat shaped plunger with a coil spring contacting the rim thereof and located in the receiver cavity.

14. A machine gun as recited in claim 11, further including a stop means for limiting travel of the top strap in covering arrangement over the receiver top where the receiver top strap forward end includes arcuate grooves formed in opposite sides thereof for fitting in complementary rounded forward ends of the longitudinal sides of the stepped portion of the receiver top.

15. A machine gun as recited in claim 10, wherein the means for maintaining the cartridge feed block means consists of a seat for said cartridge feed block means forward from said receiver stepped portion, with said top strap forward end to overhang one end of said seat, to closely fit proximate to and across one end of said cartridge feed block means when said top strap is installed in covering attitude over said receiver top, and forwardly projecting spaced apart ears that extend in the plane of said cartridge feed block means to fit within complementary slots formed in opposite sides of the barrel breech.

16. A machine gun as recited in claim 15, wherein the ears and complementary slots are arcuate in shape.

17. A machine gun as recited in claim 10, wherein the means, including a single screw, for aligning and securing said barrel group to said receiver group consists of a round pin fitted laterally through opposite receiver sides within and projecting upwardly from said receiver bottom to receive a complementary lateral groove formed in the barrel forward from breech end, said groove fitted on the pin functioning as a pivot such that when the barrel group is rotated therearound, bringing the barrel breech into the receiver, a radial threaded hole formed in the barrel will align with an opening formed through said receiver bottom; and a barrel retaining screw maintained in said opening in said receiver bottom that includes a threaded end for turning into said barrel radial threaded hole, to draw the barrel group into position in said receiver providing points of rigid connection at said barrel retaining screw and said pivot.

18. A machine gun as recited in claim 17, wherein the barrel retaining screw is free-wheeling in the receiver bottom opening and includes a large head to accomodate manual turning.

* * * * *